United States Patent [19]

Hirakura et al.

[11] 4,242,434

[45] Dec. 30, 1980

[54] TONER COMPOSITION FOR MULTIPLE COPY ELECTROSTATIC PHOTOGRAPHY

[75] Inventors: Koji Hirakura; Itsuo Ikeda; Wasaburo Ohta; Zenjiro Okuno, all of Tokyo, Japan

[73] Assignee: Ricoh Company, Ltd., Tokyo, Japan

[21] Appl. No.: 917,708

[22] Filed: Jun. 21, 1978

Related U.S. Application Data

[63] Continuation of Ser. No. 742,732, Nov. 17, 1976, abandoned.

[30] Foreign Application Priority Data

Nov. 26, 1975 [JP] Japan ..... 50/141364

[51] Int. Cl.[3] ..... G03G 9/14; G03G 15/09

[52] U.S. Cl. ..... 430/122; 118/712; 118/657; 118/658; 252/62.53; 252/62.54; 252/513; 252/519; 324/62; 355/3 DD; 355/14 D; 427/8; 430/108; 430/109; 430/126; 430/903

[58] Field of Search ..... 427/8, 18, 127, 220, 427/211; 118/9, 712, 657, 658; 96/1 SD; 252/62 P, 62 PM, 62.53, 62.54, 513, 519, 500; 428/403; 324/62; 355/3 DD, 14 D; 430/122, 108, 109, 126

[56] References Cited

U.S. PATENT DOCUMENTS

| | | | |
|---|---|---|---|
| 2,846,333 | 8/1958 | Wilson | 252/62.1 P |
| 3,278,439 | 10/1966 | Blanchette et al. | 252/62.1 P |
| 3,527,651 | 9/1970 | Shelffo et al. | 427/8 |
| 3,639,245 | 2/1972 | Nelson | 252/62.1 P |
| 3,802,381 | 4/1974 | O'Neill et al. | 118/9 |
| 3,838,054 | 9/1974 | Trachtenberg et al. | 252/62.1 P |
| 3,850,663 | 11/1974 | Hagenbach | 252/62.1 P |
| 3,895,125 | 7/1975 | Tsuchiya et al. | 427/18 |
| 3,898,170 | 8/1975 | Kasper | 252/62.1 L |
| 3,947,370 | 3/1976 | Miller | 252/62.1 P |
| 3,996,392 | 12/1976 | Berg et al. | 252/62.1 P |
| 4,082,681 | 4/1978 | Takayama et al. | 252/62.1 P |
| 4,108,786 | 8/1978 | Takayama et al. | 427/18 |

*Primary Examiner*—John D. Smith

*Attorney, Agent, or Firm*—Jordan and Hamburg

[57] ABSTRACT

In controlling the operation of an electrostatic apparatus to produce a large number of copies from an electrostatic image in a multiple copy process there is utilized a toner substance comprising a magnetic carrier composition in which each particle of the composition comprises a ferromagnetic material and a resin, the effective conductivity of the composition being determined by testing means separate from the electrostatic apparatus such that the effective conductivity is measured while the composition is free of absorbed water vapor and other gases encountered under operating conditions with the electrostatic apparatus.

20 Claims, 3 Drawing Figures

TONER COMPOSITION FOR MULTIPLE COPY ELECTROSTATIC PHOTOGRAPHY

This is a continuation of application Ser. No. 742,732 filed Nov. 17, 1976, now abandoned.

BACKGROUND OF THE INVENTION

The present invention relates to a toner substance for electrostatic photography and more particularly to a magnetic carrier composition constituting a component of the toner substance which enables a large number of copies to be produced by repeated developing and transfer from a single electrostatic image.

A toner substance for use in electrostatic photography in which a magnetic brush developing method is employed generally comprises fine particles of charge detecting composition mixed with fine particles of magnetic carrier composition. The charge detecting composition effects transfer of the toner substance from the magnetic brush to an electrostatic image of an original document which is formed on a photoconductive drum or belt and the magnetic carrier particles facilitate the formation of the magnetic brush.

A magnetic brush developing unit generally comprises an insulating cylinder disposed closely adjacent to the rotating photoconductive drum and one or magnets disposed inside the cylinder. The toner substance is applied to the cylinder and either one or both of the cylinder and magnet(s) are rotated so that the particles of the toner substance magnetically adhere to the cylinder in the form of a rotating magnetic brush of toner substance. The magnetic brush is maintained in brushing contact with the drum so that the toner particles adhere to the areas of the electrostatic image coresponding to the dark areas of the original document.

In many business and bureaucratic operations it is desirable to produce a large number of copies of a single original document. Since developing and transfer operations may be carried out at considerably higher speeds than an imaging operation, due to the photosensitivity of the photoconductive layer on the drum, it is desirable to perform the imaging operation only once, forming an electrostatic image on the drum, and to repeatedly develop and transfer from the image to produce a large number of copies at high speed.

However, a problem has heretofore remained in such a multiple copy process in that the alphanumeric characters and thinner line areas of the image progressively grow thinner as more copies are made, and eventually disappear. This has limited the number of copies which can be produced from a single electrostatic image to only 15-20.

It has been determined in accordance with the present invention that the cause of this detrimental effect lies in the magnetic carrier composition of the toner substance. Since the carrier composition generally consists of fine iron particles of ferromagnetic oxides, the conductivity thereof is quite high, causing discharge of the electrostatic image on the drum.

More particularly, such conductive carrier particles provide a discharge path for the high potential portions of the electrostatic image both to the magnetic brush and also to the low potential portions of the electrostatic image. This latter effect takes place most effectively at the edges of the high potential areas, thereby gradually eroding the edges as the developing operation is repeated. The effect is minimum in the central portions of solid black image areas, even though the edges of such areas are gradually eroded. However, thin lines and typewritten alphanumeric characters and symbols tend to become so thin as to disappear entirely after less than 20 copies are made.

In an attempt to eliminate this undesirable effect, toner substances have been introduced in which the magnetic carrier particles are coated with a highly insulating coating. Unfortunately, the results of using these toner substances appears to be about the same as with the simple iron carrier particles in the number of copies that can be produced due to thinning of image areas. In addition, the insulating coating is quite tough and tends to abrade the delicate photoconductive layer on the drum. However, the reason for the failure of the coated carrier particles is entirely different from that of the uncoated particles.

Due to the extremely low conductivity of the coated carrier particles, they are easily electrostatically charged and hold the charge for a long time. With the magnetic brush constantly sweeping toner substance in contact with the drum, many carrier particles contact high potential areas of the electrostatic image, become electrostacally charged thereby removing a corresponding amount of charge from the electrostatic image, and subsequently contact low potential areas of the electrostatic image to become discharged. In this manner, charge is effectively removed from the electrostatic image by the carrier particles. The effect, as in the case of the uncoated carrier particles, is most noticable in the thin areas of the image.

SUMMARY OF THE INVENTION

It is therefore an object of the present invention to greatly reduce the thinning of an electrostatic image on a photoconductive drum in an electrostatic copying process in which many copies are made from a single electrostatic image so that the number of copies which may be produced is increased.

It is another object of the present invention to greatly increase the number of copies which may be produced from a single electrostatic image in a multiple copy process.

It is another object of the present invention to provide an improved toner composition of electrostatic photography.

It is another object of the present invention to provide a carrier composition for dry electrostatic photography comprising particles of a ferromagnetic material and a resin and having an effective conductivity between $10^{-15}$ and $10^{-5}$ $ohms^{-1}$ $cm^{-1}$.

It is another object of the present invention to provide a generally improved multiple copy electrostatic photography process.

Other objects, together with the foregoing, are attained in the emodiments described in the following description and illustrated in the accompanying drawings.

DESCRIPTION OF THE PREFERRED EMBODIMENTS

While the toner substance of the invention is susceptible of numerous physical forms, depending upon the environment and requirements of use, substantial numbers of the herein shown and described compositions have been made, tested and used, and all have performed in an eminently satisfactory manner.

Figure 1:
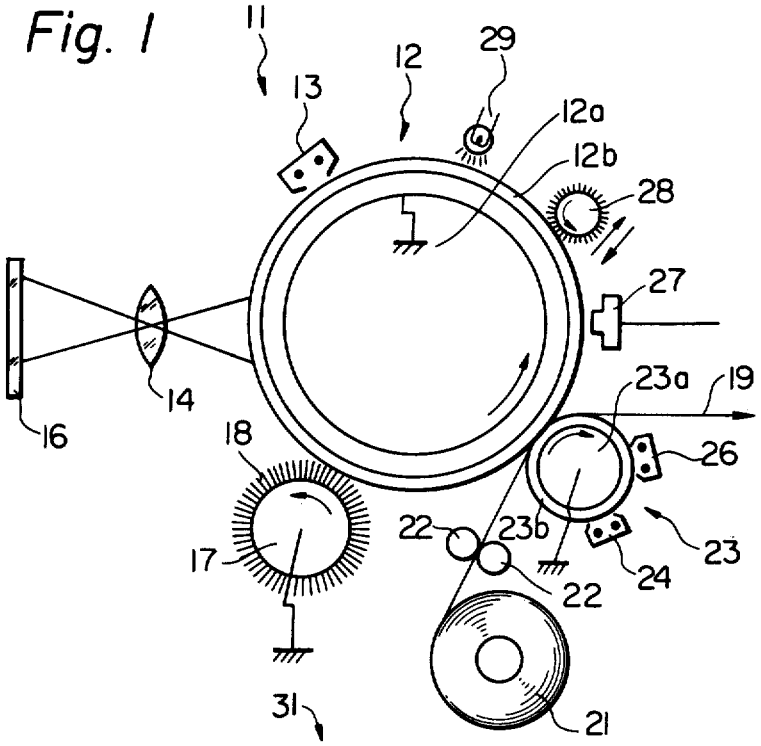
FIG. 1 is a schematic representation of an electrostatic photography apparatus to which the present invention relates.

FIG. 1 shows an electrostatic copying machine 11 to which the present invention relates. The copying machine 11 comprises a photoconductive drum 12 which is rotated counterclockwise at constant speed. The drum 12 comprises a grounded conductive core 12a and a photoconductive layer 12b formed on the surface of the core 12a. The photoconductive layer 12b is typically formed of amorphous selenium, a zinc oxide-resin dispersion or an organic semiconductor such as poly-N-vinyl-carbazole. A corona charging unit 13 applies a uniform electrostatic charge to the drum 12. An imaging unit is symbolized by a converging lens 14 to focus an image of an original document 16 onto the surface of the drum 12 in a synchronized manner. A magnetic brush 17 is rotated counterclockwise to apply a toner substance indicated at 18 onto the surface of the drum 12. Copy paper 19 is fed from a roll 21 by means of feed rollers 22 between the drum 12 and a transfer drum 23. The transfer drum 23 comprises a conductive grounded core 23a and a dielectric outer layer 23b and is rotated clockwise. A corona charging unit 24 and a corona discharging unit 26 are operatively arranged adjacent to the surface of the transfer drum 23. A sensor 27 is provided to mesure the electostatic potential on the drum 12. A magnetic brush cleaning unit 28 is rotated counterclockwise and is movable into contact with the drum 12 to remove residual toner substance therefrom and a light source 29 illuminates the drum 12 to dissipate any remaining charge prior to charging by the charging unit 13.

In operation, the corona charging unit 13 applies a uniform electrostatic charge to the photoconductive layer 12b of the drum 12 in the dark. The photoconductive layer 12b has the property of holding the charge for a long period or time unless exposed to light. The lens 14 subsequently radiates a light image of the original document 16 onto the drum 12 thereby causing local photoconduction in the areas of the image corresponding to light areas of the original document. The electrostatic charge is dissipated in these light areas by photoconduction through the layer 12b to the grounded core 12a to form an electrostatic image of the original document 16 on the drum 12. Either the document 16 or the lens 14 is moved in synchronism with the movement of the drum 12 in a conventional manner to image the drum 12.

The magnetic brush 17 applies the toner substance 18 to the surface of the drum 12 to develop the electrostatic image. The toner substance comprises charge detecting particles and magnetic carrier particles. Due to the presence of the carrier particles the toner substance 18 adheres to the magnetic brush 17.

Through contact of the magnetic brush 17 with the drum 12, the toner substance 18 is electrostatically attracted by means of the charge detecting particles to the high potential or dark image areas of the electrostatic image to form a toner image on the drum 12. As the leading edge of the toner image reaches the transfer roller 23, the feed rollers 22 are energized and the transfer roller 23 is moved into contact with the paper 19 to feed the paper 19 between the drum 12 and transfer roller 23. The transfer roller 23 is driven at the same speed as the drum 12 and the dilectric layer 23b is charged by the charging unit 24 with the same polarity as the charging unit 13. As a result, this charge acts on the toner substance through the paper 19 to electrostatically attract the toner substance from the drum 12 to the paper 19. The toner image, thereby transferred to the paper 19, is fixed thereto by heat or pressure or a combination thereof, although the means for performing the fixing operation is not shown, to provide a permanent copy. The discharging unit 26 discharges the transfer roller 23 prior to recharging by the charging unit 24 to maintain the electrostatic potential on the dielectric layer 23b at the proper value for toner image transfer. The sensor 27 senses the electrostatic potential remaining on the surface of the drum 12.

For subsequent copies of the same document 16, the rotation of the drum 12 and transfer roller 23 is preferably speeded up to within a functional limit and the charging unit 13 and imaging unit symbolized by the lens 14 are de-energized. The steps of developing and transferring the toner image from the electrostatic image on the drum 12 are repeated until the required number of copies are produced. After the last copy is produced, the cleaning unit 28 is moved into contact with the drum 12 to remove any residual toner substance therefrom and the light source 29 is energized to cause photoconduction of the entire surface of the layer 12b and thereby discharge the electrostatic image. The operations described are repeated to copy another document 16.

In the process described above, dissipation of the electrostatic image is produced by three causes during the multiple copying operation. Since the photoconductive layer 12b is not a complete insulator, some discharge naturally occurs therethrough with time. A certain amount of discharge also occurs during the transfer operation. However, the greatest amount of discharge takes place during the developing operation, and the present invention reduces this discharge to such a great extent that at least 100–200 copies of acceptable quality may be produced from a single electrostatic image.

As mentioned above, if the conductivity of the carrier particles in the toner substance is too great, the carrier particles will cause discharge of the electrostatic image through conduction to a point of lower potential. If the conductivity is too high, the carrier particles will also cause discharge of the electrostatic image through the mechanism of charge removal. It is possible to measure the discharge of the electrostatic image in several ways. The sensor 27 illustrated in FIG. 1 measures the decrease of the average electrostatic potential on the drum 12 as the result of repeated developing operations. It is also possible to determine the amount of discharge by measuring the corresponding current flow from the magnetic brush 17 to the core 12a of the drum 12.

Figure 2:
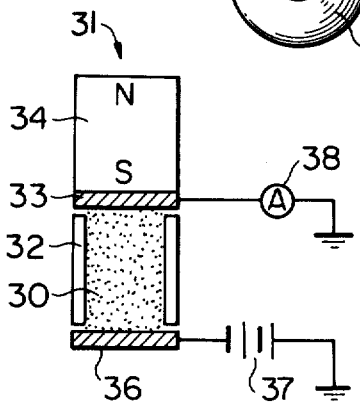
FIG. 2 is a schematic representation of a testing apparatus for determining the effective conductivity of a magnetic carrier composition of a toner substance when utilized in a magnetic brush developing process.

In order to accurately determine the effect of the conductivity of the carrier particle composition on the amount of discharge of the electrostatic image, it is necessary to measure the effective conductivity of the carrier composition under test. Since the adsorption of water vapor and other gases on the surfaces of the carrier particles has the effect of greatly increasing the conductivity thereof, it is impossible to determine the effective conductivity of a carrier composition when utilized in a magnetic brush developing process from the intrinsic conductivities of the components of the composition. For this reason, a testing apparatus 31 which is illustrated in FIG. 2 was utilized to measure the effective conductivity of carrier compositions. The testing apparatus 31 is adapted to accurately simulate the magnetic brush 17 and comprises an insulated cell 32, the interior of which is a 1 cm cube. The top of the cell 32 is constituted by an electrode 33, above which is disposed a magnet 34. The cell 32 is filled with a carrier composition 30 under test in such a manner that the carrier composition 30 is retained in the cell 32 by the effect of the magnet 34 alone, thereby substantially simulating the magnetic brush 17. An electrode 36 is then fitted to the bottom of the cell 32.

A battery 37 is connected between the electrode 36 and ground and an ammeter 38 is connected between the electrode 33 and ground in such a manner that the ammeter indicates the current through the carrier substance 30. The ratio of the current to the battery voltage gives the conductivity of the carrier composition 30. It has been determined through the apparatus illustrated in FIGS. 1 and 2 that if the effective conductivity of the carrier composition is greater than $10^{-5}$ ohms$^{-1}$ cm$^{-1}$, the electrostatic image will be discharged due to conduction of the carrier particles. If the conductivity is smaller than $10^{-15}$ ohms$^{-1}$ cm$^{-1}$, the electrostatic image will be discharged through charge removal by the carrier particles. Within the optimum range of $10^{-15}$ and $10^{-5}$ ohms$^{-1}$ cm$^{-1}$, the discharge of the electrostatic image is minimum and as many as 100–200 copies may be produced from a single electrostatic image.

In accordance with the present invention, it has been determined that carrier particles formed entirely of iron or a ferromagnetic oxide are entirely too conductive. If such carrier paticles are merely coated with an insulator, the conductivity becomes too low, and in addition, abrasion of the photoconductive layer of the drum occurs. The invention, however, provides an entirely new carrier composition in which carrier particles are formed of ferromagnetic material and a resin in such a manner that the conductivity may be accurately provided in the desired range of $10^{-15}$ to $10^{-5}$ ohms$^{-1}$ cm$^{-1}$.

The particles of carrier composition in accordance with the present invention for use in a magnetic brush developing process preferably have a diameter between 20 and 200 microns, and the ferromagnetic material in the carrier particles is typically in the form of particles having a diameter on the order of one micron.

As the ferromagnetic material in the carrier composition, iron, cobalt, nickel and ferromagnetic oxides produce good results. The ferromagnetic oxides for use in the invention may be selected from the following groups.

1. $MFe_2O_4$ where M is a divalent metal such as Mn, Fe, Co, Ni, Cu, Zn, Mg and Cd.
2. $MFe_{12}O_{19}$ where M is Ba, Sr or Pb.
3. $MFeO_3$ where M is a rare earth metal.
4. $M_3Fe_5O_{12}$ where M is a rare earth metal.
5. $MMnO_3$ where M is Ni, Co, La or Ca.

Also effective is $CrO_2$. As the resin, good results have been obtained from thermoplastic polyester, a copolymer of styrene and methyl methacrylate, a copolymer of styrene and acrylonitrile and a copolymer of styrene, acrylonitrile and butadiene. The ferromagnetic materials may be used either singly, in a mixture or in a solid solution comprising two or more of the same or different types of ferromagnetic oxides. It will be noted that $MFe_2O_4$ is a ferrite which has been previously utilized as the material for carrier particles.

It has been determined that the ferromagnetic oxides listed above are all stable over a long period of practical use and are also relatively inexpensive. In addition, it is possible to formulate these ferromagnetic oxides with conductivities so low that they may be considered as insulators. However, it is difficult to reduce the conductivity below $10^{-11}$ ohms$^{-1}$ cm$^{-1}$, and in addition, adsorption of gases, particularly water vapor, on the surfaces of the carrier particles in considerable and has the effect of increasing the conductivity to an unacceptable extent. For this reason, the present invention combines these materials with electrically insulating resins.

A carrier composition in accordance with the present invention may be manufctured by the following preferred but exemplary processes.

Process 1
a. Heating a thermoplastic resin to plasticity.
b. Adding fine ferromagnetic particles to the resin.
c. Homogenizing the mixture.
d. Allowing the mixture to cool to solidity.
e. Grinding or otherwise forming the material into particles of proper size.

Process 2
a. Providing a liquid containing a suitable binding agent.
b. Adding fine ferromagnetic particles to the liquid.
c. Homogenizing the mixture.
d. Spray drying to form particles of proper size.
e. Impregnating the particles with resin.

Process 3
a. Providing a liquid containing a suitable binding agent.
b. Adding fine ferromagnetic particles to the liquid.
c. Homogenizing the mixture.
d. Spray drying to form particles of proper size.
e. Heating to sinter the particles.
f. Impregnating the resulting hard and porous particles with resin.

Process 4
a. Providing a resin in liquid form.
b. Adding fine ferromagnetic particles to the liquid.
c. Spray drying the mixture to solidify the resin and form particles of proper size.

Process 5
a. Adding a liquid monomer to a liquid such as water in which the monomer is insoluble.
b. Adding fine ferromagnetic particles to the mixture.
c. Homogenizing the mixture.
d. Creating conditions under which suspension polymerization will occur to form particles of proper size.

Figure 3:
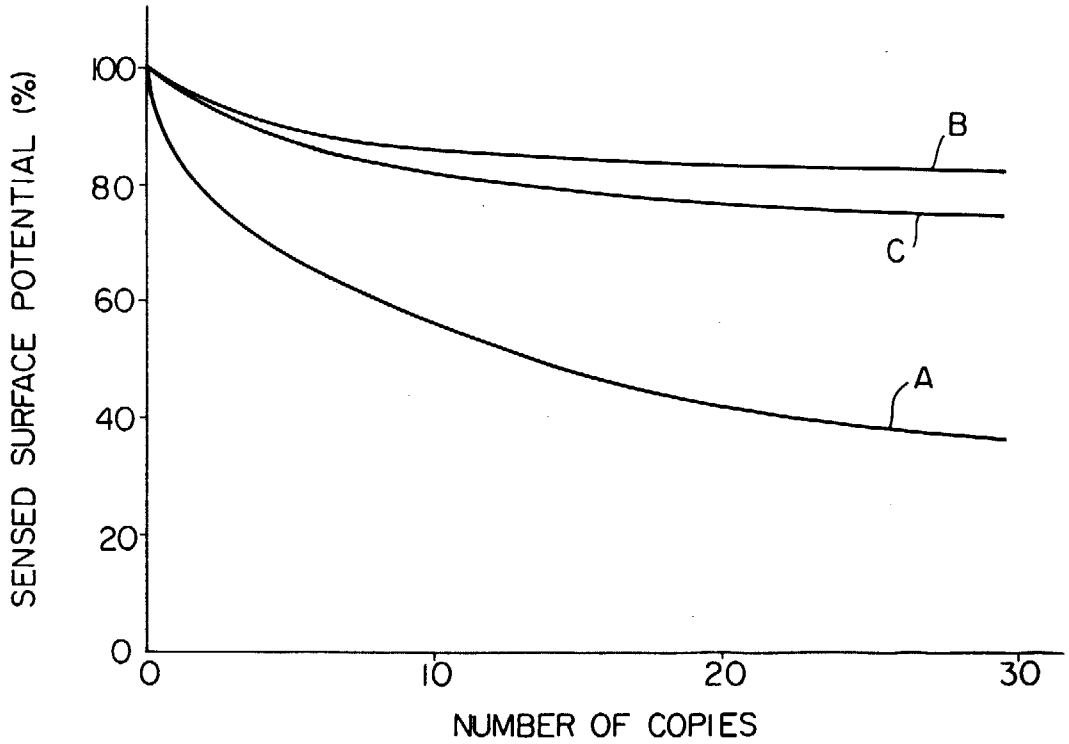
FIG. 3 is a graph illustrating the performance of the present invention compared with the prior art.

In order to illustrate the performance of the present invention, the following examples are presented with reference being made to FIGS. 1 and 3.

EXAMPLE 1

An organic photoconductor comprising poly-N-vinyl carbazole and trinitrofluorenone complex was applied onto an aluminum core **12*a* of the drum 12 to form a photoconductive layer 12*b* about 10 microns thick. The surface of the drum 12 was uniformly charged by the corona charging unit 13 to a potential of −600 V. The dielectric layer 23*b* of the transfer roller 23 was formed of TEFLON (TRADEMARK) to a thickness of 120 microns and charged by means of the units 24 and 26 to a potential of −120 V. A checkered optical image was radiated onto the drum 12 by the lens 14 and was repeatedly developed by the magnetic brush 17. The toner substance used was a commercial product comprising carrier particles each consisting of an iron core coated with $Fe_3O_4$. After each developing operation the toner image was transferred to the paper 19 by the transfer roller 23 and the potential on the drum 12 was measured by the sensor 27**.

FIG. 3 shows the results of the experiment. As indicated by a curve A, the potential of the drum 12 dropped to below 40% of its original value after only 30 copies were made. In addition, only the first 3 copies were of acceptable quality.

EXAMPLE 2

The drum 12 and transfer roller 23 were prepared in the same manner as in example 1. However, the commercial toner substance was replaced by a toner substance in accordance with the present invention which was prepared as follows.

The toner substance consisted of 95 parts by weight of a magnetic carrier composition and 5 parts by weight of charge detecting composition. The carrier composition was prepared by dispersing a homogenizing fine particles of barium ferrite consisting mainly of $BaO.6Fe_2O_3$ and having a particle diameter of about 1 micron in an aqueous polyvinyl alcohol solution and spray drying to produce particles of the required size. The particles were heated and sintered to produce hard and porous particles. These particles were immersed in a solution of methyl methacrylate and styrene to impregnate the particles with resin and then dried to polymerize the resin. These particles of carrier composition were about 100 microns in diameter and had an effective conductivity between $10^{-13}$ and $10^{-14}$ $ohms^{-1}$ $cm^{-1}$.

The results of substituting this carrier composition with the commercial product are illustrated by a curve B in FIG. 3. It will be seen that the electrostatic potential decreased by only a slight amount after 30 copies were produced. In addition, over 200 copies of acceptable quality were produced.

EXAMPLE 3

The photoconductive layer **12*b* of the drum 12 was formed by vacuum depositing amorphous selenium on the aluminum core 12*a* to a thickness of about 25 microns. The surface of the drum 12 was charged by the charging unit 13 to +600 V. The dielectric layer 23*b* of the transfer drum 23 was formed of TEFLON to a thickness of about 120 microns and charged to +1200 V by the units 24 and 26**. The toner substance used consisted of 90 parts by weight of carrier composition and 10 parts by weight of charge detecting powder. The carrier composition was produced by providing a homogeneous mixture of styrene and acrylonitrile in water and adding thereto fine particles of $Fe_3O_4$ having a diameter of about 500 Å. Suspension polymerization was then effected to produce carrier particles about 100 microns in diameter and having an effective conductivity of about $10^{-14}$ $ohms^{-1}$ $cm^{31\ 1}$.

The results obtained with this carrier composition are illustrated by a curve C in FIG. 3, and are approximately the same as obtained by the carrier composition of example 2.

While the carrier composition of the present invention has been described as being used in conjunction with a photoconductive drum, it can also be used in a copying process utilizing an electrostatic transfer member in the form of a base material having formed thereon a dielectric layer. It is also applicable to a cascade developing process, in which case the particle size is preferably between 300 and 1000 microns.

Whereas the present toner substance has been described as comprising particles of a charge detecting composition and particles of a magnetic carrier composition, the carrier particles may be used alone as a one-component toner substance for conventional dry copying. In this case, the diameter of the particles is preferably between 10 and 50 microns. In such as application, it is desirable that the resin be selected so that the carrier particles exhibit plasticity and that the carrier particles be susceptible to thermal fixing.

Many other modifications within the scope of the invention will become possible for those skilled in the art after receiving the teachings of the present disclosure.

What is claimed is:

1. In a method of controlling the operation of an electrostatic apparatus to produce a large number of copies from an electrostatic image in a multiple copy process, the electrostatic apparatus being of the type comprising a photoconductive member, imaging means for radiating a light image onto the photoconductive member, developing means including a magnetic brush for applying a dry toner substance onto the surface of the photoconductive member and forming a toner image thereon, and means for transferring the toner image onto the paper to thereby reproduce a copy of the image, the method comprising utilizing a toner substance comprising a magnetic carrier composition, providing an effective conductivity of between $10^{-15}$ and $10^{-5}$ $ohms^{-1}$ $cm^{-1}$ for the magnetic carrier composition, each particle of the composition comprising a ferromagnetic material and a resin and having a diameter between 20 and 200 microns , and determining the effective conductivity by testing means separate from the electrostatic apparatus such that the effective conductivity is measured while the composition is free of absorbed water vapor and other gases encountered under operating conditions with the electrostatic apparatus, said effective conductivity being determined by disposing said magnetic carrier composition in a cell in which an electrode is disposed at the top thereof, retaining said magnetic carrier composition in said cell by a magnet disposed above said electrode thereby substantially simulating said magnetic brush, and measuring the electric current passing through said magnetic carrier composition in said cell utilizing said electrode and another electrode at the bottom of said cell and a power source, whereby said measurement is utilized to determine said effective conductivity of said magnetic carrier composition.

2. In an electrostatic and testing apparatus operable to produce a large number of copies from an electrostatic image in a multiple copy process, the combination comprising a photoconductive member, imaging means for radiating a light image onto the photoconductive member, developing means including a magnetic brush for applying a dry toner substance onto the surface of the photoconductive member and forming a toner image thereon, means for transferring the toner image onto the paper to thereby reproduce a copy of the image, said toner substance comprising a magnetic carrier composition, said magnetic carrier composition having an effective conductivity of between $10^{-15}$ and $10^{-5}$ ohms$^{-1}$ cm$^{-1}$, and each particle of said composition comprising a ferromagnetic material and a resin and having a diameter between 20 and 200 microns, testing means for determining said effective conductivity separate from the electrostatic apparatus such that the effective conductivity is measures while said composition is free of absorbed water vapor and other gases encountered under operating conditions with the electrostatic apparatus, said testing means comprising an insulated cell in which the magnetic carrier composition is disposed, an electrode disposed at the top of said cell, a magnet means disposed above said electrode such that the magnetic carrier composition is retained in the cell by the effect of said magnet means thereby substantially simulating said magnetic brush, another electrode at the bottom of said cell, and means connected to said electrodes for passing and measuring an electric current through the magnetic carrier composition in said cell to thereby determine said effective conductivity of said magnetic carrier composition.

3. The combination as in claim 2, in which each particle has a diameter between 20 and 200 microns.

4. The combination as in claim 2, in which the ferromagnetic material is selected from the group consisting of Fe, Co, Ni, and a ferromagnetic oxide.

5. The combination as in claim 2, in which the ferromagnetic material has the approximate formula $MFe_2O_4$ where M is a divalent metal.

6. The combination as in claim 2, in which the ferromagnetic material has the approximate formula $MFe_2O_4$ where M is selected from the group consisting of Mn, Fe, Co, Ni, Cu, Zn, Mg, Cd.

7. The combination as in claim 2, in which the ferromagnetic material hs the approximate formula $MFe_{12}O_{19}$ where M is selected from the group consisting of Ba, Sr and Pb.

8. The combination as in claim 2, in which the ferromagnetic material has the approximate formula $MFeO_3$ where M is a rare earth metal.

9. The combination as in claim 2, in which the ferromagnetic material has the approximate formula $M_3Fe_5O_{12}$ where M is a rare earth metal.

10. The combination as in claim 2, in which the ferromagnetic material has the approximate formula $MMnO_3$ where M is selected from the group consisting of Ni, Co, La and Ca.

11. The combination as in claim 2, in which the ferromagnetic material has the approximate formula $CrO_2$.

12. The combination as in claim 2, in which the ferromagnetic material has the approximate formula $BaO.6Fe_2O_3$.

13. The combination as in claim 2, in which the resin is a thermoplastic polyester.

14. The combination as in claim 2, in which the resin is a copolymer of styrene and methyl methacrylate.

15. The combination as in claim 2, in which the resin is a copolymer of styrene and acrylonitrile.

16. The combination as in claim 2, in which the resin is a copolymer of styrene, acrylonitrile and butadiene.

17. The combination as in claim 2, wherein the first said electrode constitutes the top of said cell.

18. The combination as in claim 2, wherein said means connected to said electrodes comprises a battery and an ammeter, whereby the ammeter indicates the current through the magnetic carrier composition and the ratio of the current to this battery voltage determines said effective conductivity of said magnetic carrier composition.

19. The combination as in claim 2, wherein said cell is filled with said magnetic carrier composition.

20. The combination as in claim 2, wherein the interior of said cell is one cubic centimeter.

* * * * *